US006286441B1

(12) United States Patent
Burdi et al.

(10) Patent No.: US 6,286,441 B1
(45) **Date of Patent: *Sep. 11, 2001**

(54) HEIGHT ADJUSTABLE WORK SURFACE AND CONTROL THEREFOR

(75) Inventors: Roger D. Burdi; Richard H. Baker, both of Grand Rapids; John W. Ooms, Wyoming, all of MI (US)

(73) Assignee: Steelcase Development Corporation, Caledonia, MI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/302,919

(22) Filed: Apr. 30, 1999

(51) Int. Cl.[7] ..... A47B 9/00

(52) U.S. Cl. ..... 108/147; 108/20; 108/147.19

(58) Field of Search ..... 108/147, 147.19, 108/144.11, 20, 21, 50.01; 312/223.1, 223.3, 194; 248/188.2, 188.3, 188.4, 188.5; 318/626, 625, 649, 45

(56) References Cited

U.S. PATENT DOCUMENTS

| | | |
|---|---|---|
| 2,239,101 | 4/1941 | Jeffers . |
| 2,370,834 | 3/1945 | Ball . |
| 2,425,442 | 8/1947 | Schall, Jr. et al. . |
| 2,596,033 | 5/1952 | King . |
| 2,716,723 | 8/1955 | King . |
| 3,135,905 | 6/1964 | Malcho . |
| 3,149,273 | 9/1964 | Wallace et al. . |
| 3,174,087 | 3/1965 | Hannicq et al. . |
| 3,207,099 | 9/1965 | Black et al. . |
| 3,285,207 | 11/1966 | Vom Hagen . |
| 3,304,892 | 2/1967 | Bengtson . |
| 3,347,511 | 10/1967 | Myers . |
| 3,458,788 | 7/1969 | Ljung . |
| 3,554,491 | 1/1971 | Tegtmeier . |
| 3,680,836 | 8/1972 | Amelotte et al. . |
| 3,707,930 | 1/1973 | Yindra et al. . |
| 3,724,895 | 4/1973 | Brand . |
| 3,836,162 | 9/1974 | Felkner . |
| 3,890,907 | 6/1975 | Peterson . |

(List continued on next page.)

FOREIGN PATENT DOCUMENTS

| | | | | |
|---|---|---|---|---|
| 916212 | | 8/1954 | (DE) . | |
| 0021089 | | 5/1980 | (EP) . | |
| 8706439 | * | 11/1987 | (WO) | 108/147 |
| 092018033 | * | 10/1992 | (WO) | 108/147 |

OTHER PUBLICATIONS

VariTask™ E–Series by Mayline® The Leader in Technical Desking Solutions, 3 pages, 1995.

*Primary Examiner*—Peter M. Cuomo
*Assistant Examiner*—Hanh V. Tran
(74) *Attorney, Agent, or Firm*—Price, Heneveld, Cooper, DeWitt & Litton

(57) ABSTRACT

A motorized height adjustable table having a support base, a top assembly including a substantially horizontally disposed work surface, and first and second powered drive assemblies for raising and lowering the work surface. The first and second drive assemblies have first and second electric motors and drivingly engage the top assembly for effecting vertical movement of the top assembly to adjust the height of the work surface. A controller is coupled to the first and second drive assemblies for simultaneously controlling the first and second electric motors. The controller senses a relative height displacement between the first and second drive assemblies and de-energizes the motor controlling for the leading drive assembly until the relative difference in height between the first and second drive assemblies is substantially zero.

27 Claims, 12 Drawing Sheets

U.S. PATENT DOCUMENTS

| | | | | |
|---|---|---|---|---|
| 4,124,191 | | 11/1978 | Hofmann . | |
| 4,130,069 | | 12/1978 | Evans et al. . | |
| 4,309,015 | | 1/1982 | Mühr . | |
| 4,315,466 | | 2/1982 | Boerigter . | |
| 4,318,195 | | 3/1982 | Reppas . | |
| 4,382,490 | * | 5/1983 | Ouellette | 108/20 X |
| 4,435,862 | | 3/1984 | King et al. . | |
| 4,440,096 | | 4/1984 | Rice et al. . | |
| 4,477,045 | * | 10/1984 | Karasawa et al. | 108/147 X |
| 4,505,455 | | 3/1985 | Beatty . | |
| 4,515,087 | | 5/1985 | Kurrasch . | |
| 4,590,865 | | 5/1986 | Rütsche et al. . | |
| 4,593,874 | | 6/1986 | Dunagan . | |
| 4,600,085 | | 7/1986 | Gagnon et al. . | |
| 4,604,955 | | 8/1986 | Fleischer et al. . | |
| 4,615,279 | | 10/1986 | de la Haye . | |
| 4,619,208 | | 10/1986 | Kurrasch . | |
| 4,627,364 | | 12/1986 | Klein et al. . | |
| 4,651,652 | | 3/1987 | Wyckoff . | |
| 4,667,605 | | 5/1987 | Bastian . | |
| 4,669,696 | | 6/1987 | Petta . | |
| 4,714,025 | | 12/1987 | Wallin et al. . | |
| 4,747,353 | | 5/1988 | Watt . | |
| 4,753,409 | | 6/1988 | Wilcox . | |
| 4,852,500 | | 8/1989 | Ryburg et al. . | |
| 4,881,471 | | 11/1989 | Schwartz et al. . | |
| 4,885,998 | | 12/1989 | Span et al. . | |
| 4,894,600 | | 1/1990 | Kearney . | |
| 4,981,085 | | 1/1991 | Watt . | |
| 5,088,421 | | 2/1992 | Beckstead . | |
| 5,224,429 | | 7/1993 | Borgman et al. . | |
| 5,230,290 | | 7/1993 | Crossman . | |
| 5,243,921 | | 9/1993 | Kruse et al. . | |
| 5,259,326 | | 11/1993 | Borgman et al. . | |
| 5,282,593 | | 2/1994 | Fast . | |
| 5,289,782 | | 3/1994 | Rizzi et al. . | |
| 5,320,047 | * | 6/1994 | Deurloo et al. | 108/147 X |
| 5,323,695 | | 6/1994 | Borgman et al. . | |
| 5,337,678 | | 8/1994 | Grout . | |
| 5,339,750 | | 8/1994 | Smies . | |
| 5,355,744 | | 10/1994 | Yanagisawa . | |
| 5,361,565 | | 11/1994 | Bayer . | |
| 5,370,063 | | 12/1994 | Childers . | |
| 5,373,793 | | 12/1994 | Crossman . | |
| 5,384,520 | | 1/1995 | Yang . | |
| 5,394,809 | | 3/1995 | Feldpausch et al. . | |
| 5,402,736 | | 4/1995 | Dausch . | |
| 5,406,713 | | 4/1995 | Oman et al. . | |
| 5,408,940 | | 4/1995 | Winchell . | |
| 5,434,486 | | 7/1995 | Tanaka . | |
| 5,455,495 | * | 10/1995 | Bec | 318/625 X |
| 5,461,974 | * | 10/1995 | Reneau | 108/147 |
| 5,483,903 | | 1/1996 | Pierce et al. . | |
| 5,495,811 | | 3/1996 | Carson et al. . | |
| 5,526,756 | | 6/1996 | Watson . | |
| 5,540,160 | * | 7/1996 | Rea | 108/147 X |
| 5,549,053 | * | 8/1996 | Grout | 108/147 |
| 5,625,262 | | 4/1997 | Lapota . | |
| 5,636,394 | * | 6/1997 | Bartley | 108/147 X |
| 5,752,448 | | 5/1998 | Eyre . | |
| 5,809,908 | | 9/1998 | Catta et al. . | |
| 5,819,669 | | 10/1998 | Eyre . | |
| 5,845,590 | | 12/1998 | Seidl . | |
| 6,046,566 | * | 4/2000 | Sonoda et al. | 318/625 |

* cited by examiner

HEIGHT ADJUSTABLE WORK SURFACE AND CONTROL THEREFOR

BACKGROUND OF THE INVENTION

The present invention generally relates to a workstation having a work surface table and, more particularly, to a motorized height adjustable table assembly and control system therefor.

Conventional workstations exist which have a height adjustable work surface, i.e., table, to accommodate different users and for different uses. For example, adjustable height tables are commonly made available for supporting computers and their accessories. Some conventional height adjustable tables have employed a mechanical adjustment assembly which allows for the work surface to be manually raised and lowered in height. The mechanical height adjustment assembly generally includes a manually-operated hand crank connected to a shaft and gear assemblies at opposite ends of the table, which are often driven together by a cross-connected shaft. The mechanical drive assembly, particularly the hand crank, generally consumes a large amount of space, can be difficult to operate, and often interferes with the use of the workstation.

Conventional workstation tables have also employed an electric motor for power assistance to adjust the height of the work surface. In one approach, the motor is generally configured to drive a cross-connected linkage connecting opposite ends of the table, and thereby requires a complex mechanical assembly. Another motorized approach is disclosed in U.S. Pat. No. 5,259,326 which discloses an automatic height adjustable workstation with a pair of motors for raising and lowering each table. The aforementioned multiple motor approach monitors the rotational speed of each drive arrangement and controls the motors by varying the speed of each motor to maintain a substantially level work surface. This approach requires a pulse width modulator for adjusting the speed of the motor to slow down a faster running motor to substantially equal the speed of the slower running motor. The required motor speed control, as well as required limit switches, add to the cost and complexity of the system. In addition, the aforementioned approach uses an in-line drive arrangement which requires the addition of a brake mechanism to prevent back driving of the work surface due to heavy loads. Accordingly, it is desirable to provide a motorized height adjustable table that is less expensive and easy to use.

SUMMARY OF THE INVENTION

According to one aspect of the present invention, a motorized height adjustable table is provided having a support base, a top assembly including a substantially horizontally disposed work surface, and first and second powered drive assemblies for raising and lowering the work surface. The first drive assembly includes a first electric motor engaged with the top assembly at a first location for effecting vertical movement of the top assembly to adjust the height of the work surface. The second drive assembly includes a second electric motor engaged with a second drive member engaged with the top assembly at a second location with the top assembly for effecting vertical movement of the drive assembly to adjust the height of the work surface. A controller is coupled to the first and second drive assemblies for simultaneously controlling the first and second electric motors to maintain a substantially level work surface. The controller senses a relative height displacement between the first and second drive members and deenergizes one of the motors until the relative difference in height between the first and second drive members is substantially zero.

According to another aspect of the present invention, a motorized height adjustable table is provided having a support base, a top assembly including a substantially horizontally disposed work surface, and first and second power drive assemblies for raising and lowering the work surface. The first drive assembly includes a first electric motor engaged with the top assembly at one location for effecting vertical movement of the top assembly to adjust the height of the work surface, and the first drive assembly further includes a first drive screw and a first cantilever assembly horizontally offset from the first drive screw and operatively connected thereto so that the first drive screw raises and lowers the first cantilever assembly to correspondingly raise and lower the work surface. A second drive assembly includes a second electric motor engaged with the top assembly at another location for effecting vertical movement of the top assembly to adjust the height of the work surface, and the second drive assembly includes a second drive screw and a second cantilever assembly horizontally offset from the second drive screw and connected thereto so that the second drive screw raises and lowers the second cantilever assembly to correspondingly raise and lower the work surface. A controller simultaneously controls the first and second motors. Accordingly, the offset between the drive screws and the cantilever assemblies causes load on the work surface to create a torque to resist movement of the work surface, thereby eliminating the need for a brake.

According to yet a further aspect of the present invention, a motorized height adjustable table is provided having a support base, a top assembly including a substantially horizontally disposed work surface, a first powered drive assembly including a first electric motor and a first drive arm engaged with the top assembly at one location for effecting vertical movement of the top assembly to adjust the height of the work surface, and a second powered drive assembly including a second electric motor and second drive arm engaged with the top assembly at another location for effecting vertical movement of the top assembly to adjust the height of the work surface. A controller is provided for simultaneously controlling the first and second motors to move the first and second drive arms, and the controller senses displacement of the first and second drive arms and determines a rate of the displacement over a period of time and deenergizes the one of the first and second motors as a function of the rate of displacement. Accordingly, the controller is able to detect an overload or limit condition based on the rate of displacement, thereby eliminating the need for separate limit and overload switches.

These and other features, advantages and objects of the present invention will be further understood and appreciated by those skilled in the art by reference to the following specification, claims and appended drawings.

DETAILED DESCRIPTION OF THE PREFERRED EMBODIMENT

Figure 1:
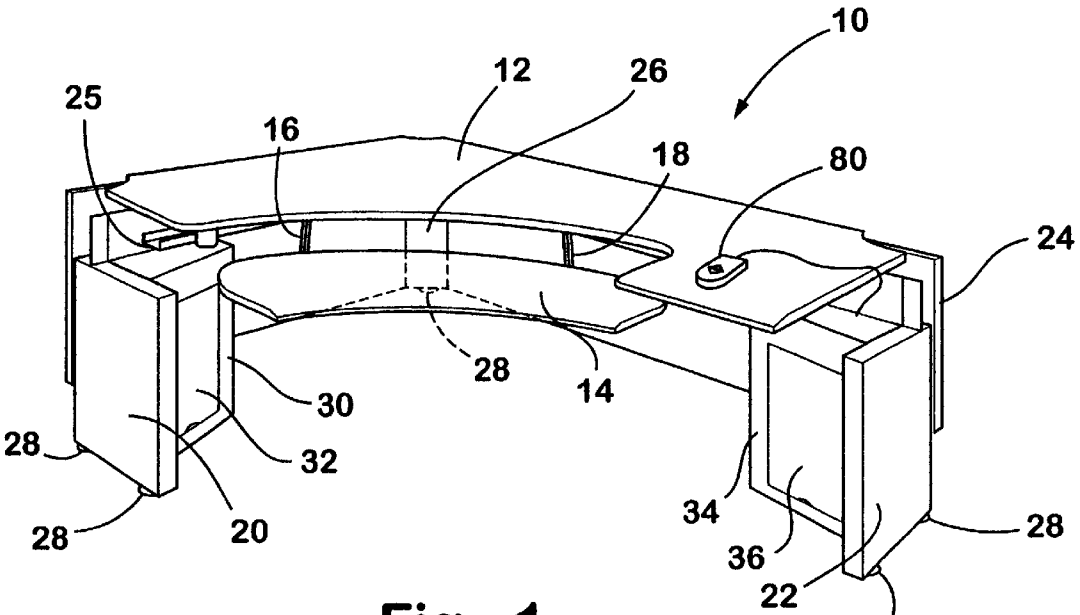
FIG. 1 is a perspective view of a height adjustable table assembly according to the present invention.

For purposes of description herein, the terms "upper," "lower," "right," "left," "rear," "front," "vertical," "horizontal," and derivatives thereof shall relate to the invention as oriented in FIG. 1, with reference to a viewer in front of and directly facing the workstation. However, it is to be understood that the invention may assume various alternative orientations and step sequences, except where expressly specified to the contrary. It is also to be understood that the specific parts, devices, and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to FIG. 1, a height adjustable table assembly 10 which forms a workstation is shown according to the present invention. The table assembly 10 shown and described herein is a dual-adjustable extended corner table assembly which generally includes a first work surface or table 12 connected to a second work surface or table 14 via adjustable connecting members 16 and 18. The first work surface 12 is generally well-suited to support a computer video display terminal and other equipment, while the second work surface is particularly well-suited to support a keyboard. The second work surface 14 is adjustable relative to the first work surface 12 in that it may be mechanically raised and lowered in relation to the first work surface 12. While first and second work surfaces 12 and 14 are shown according to a corner table assembly, it should be appreciated that the present invention provides for an adjustable work surface table which may include one or more work surfaces.

Table assembly 10 also includes a pair of end supports 20 and 22 generally located at opposite ends of the table assembly, i.e., the left and right sides, respectively. Left and right end supports 20 and 22 are fastened to an upright side wall panel 24 which forms a pair of adjoining side walls. A rail 25 extends along the inside wall of panel 24 and may provide structural support as well as support for electrical wires. Each of end supports 20 and 22 has a pair of glides 28 connected on the bottom and adapted to contact the ground. In addition, a vertical corner support member 26 is connected to side wall panel 24 at the corner joining the side walls. Support member 46 likewise has a glide 28 connected to the bottom thereof. Accordingly, the five glides 28 support the end supports 20 and 22 and corner support 26, which in turn support the back panel 24, work surface tables 12 and 14, and essentially all other components of table assembly 10.

A housing 30 is bolted or otherwise fastened to the inside wall of left end support 20 and may be further supported by rail 25. Housing 30 contains a motorized drive assembly that is operative to raise and lower the left side of the work surface 12. Housing 30 has a door 32 for allowing access to the motorized drive assembly. A housing 34 is likewise bolted or otherwise fastened to the inside wall of right end support 22 and may be further supported by rail 25. Housing 34 contains a motorized driver assembly which is operative to raise and lower the right side of work surface 12. Housing 34 also has a door 36, and further contains a controller including a processor and its associated circuitry. The left and right motorized drive assemblies are controlled by the controller in response to operator inputs via a pendant control 80.

Figure 2:
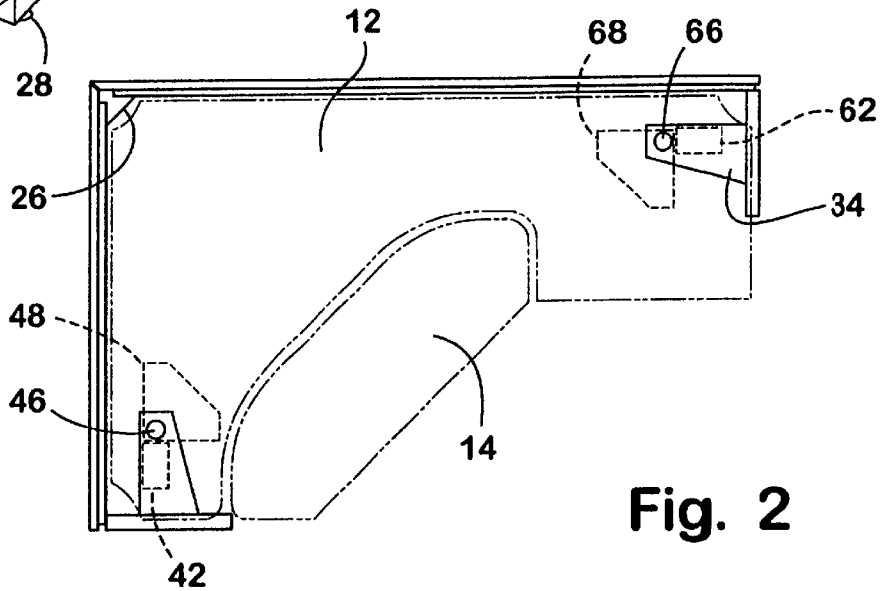
FIG. 2 is a top plan view of the table assembly showing the height adjustable support and drive assemblies.

Referring to FIG. 2, the work surface 12 is shown in phantom connected to the left and right drive assemblies. The left drive assembly generally includes an electric direct current (DC) motor, such as a 24-volt DC motor, having an electrical input coupled to a power supply and operative in either an energized or de-energized state. The motor 40 is mechanically coupled to a drive screw 44 via a gear reduction drive assembly 42. The gear reduction drive assembly 42 provides a gear ratio sufficient to raise and lower the work surface table 12 at a desired speed. According to one example, motor 40 may provide an output speed of 130 rpm, and gear reduction drive assembly 42 may provide a gear reduction ratio of 52:1. The drive screw 44, in turn, is mechanically coupled to a cantilever assembly 46 which moves linearly up and down in the vertical direction in response to rotational movement of drive screw 44. The cantilever assembly 46 is connected at its upper end to a support plate 48 which is fastened to the bottom surface of work surface 12. Accordingly, the left drive assembly operates to raise and lower the left side of work surface 12.

The right drive assembly is configured similar to the left assembly, with the exception that it is located on the right side of the work surface 12 for raising and lowering the right side of the work surface 12. The right drive assembly likewise includes a DC motor 60 mechanically engaged with a drive screw 64 via a gear reduction assembly 62. The motor 60, drive screw 64, and gear reduction assembly 62 are preferably identical to motor 40, drive screw 44, and gear reduction assembly 42. Drive screw 64, in turn, is coupled to a cylindrical cantilever assembly 66 for converting the rotational motion of drive screw 44 into a linear up and down motion of cantilever assembly 66. A support plate 68 is connected to the upper end of cantilever assembly 66, which in turn is fastened to the bottom surface of work surface table 12.

Figure 3A:
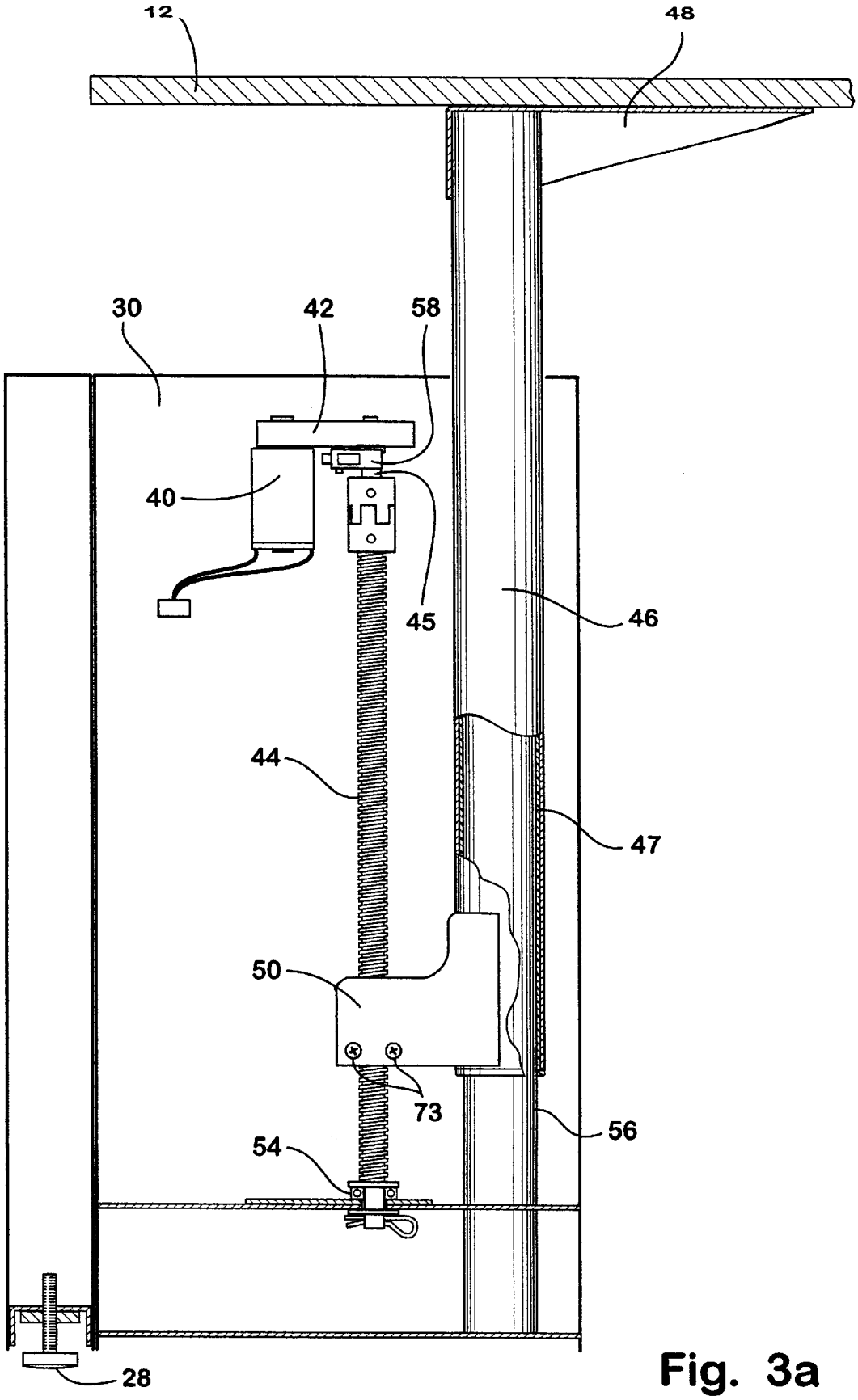
FIG. 3*a* is a partial cut-away view showing the first drive assembly.
Figure 3B:
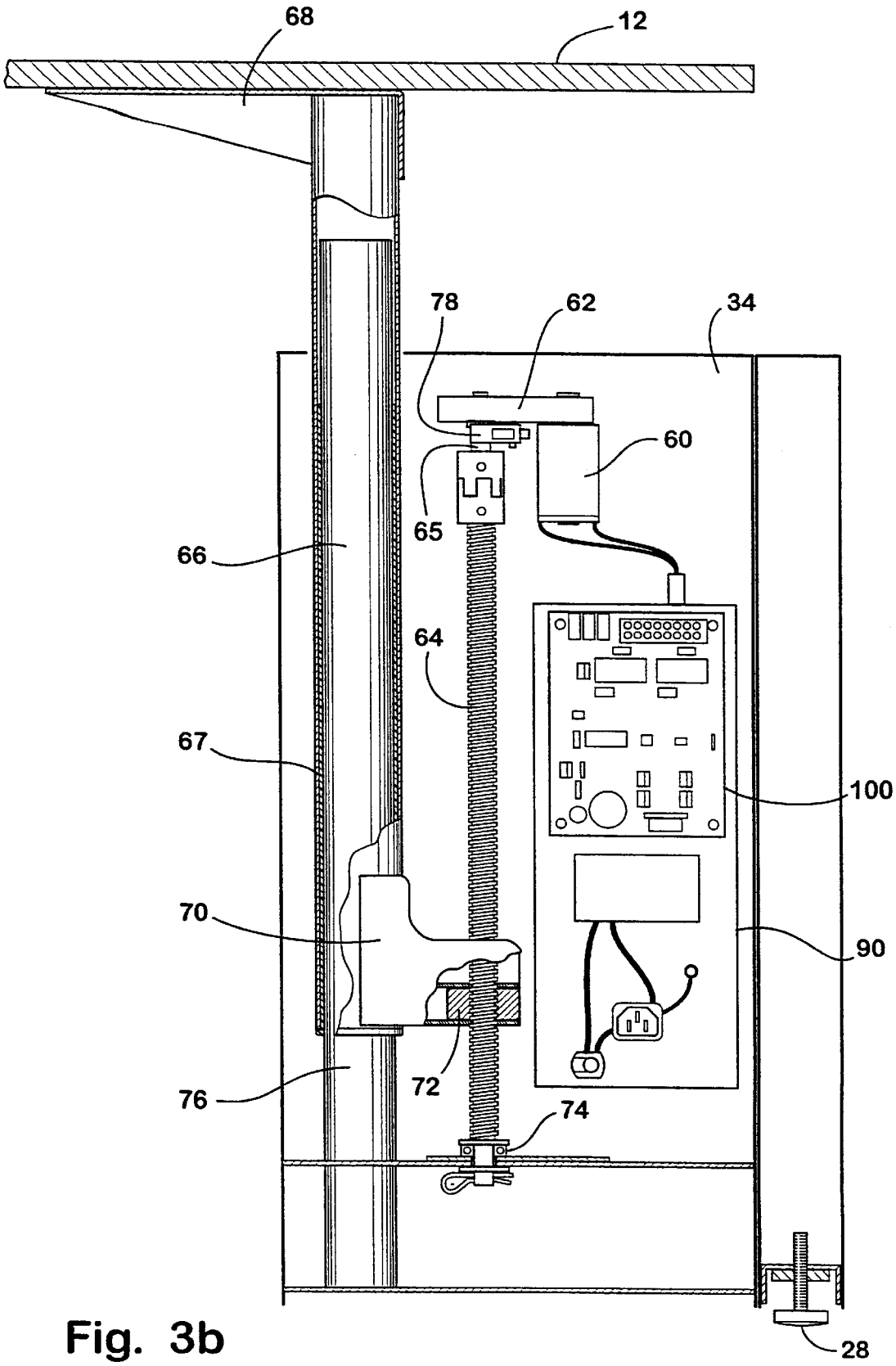
FIG. 3*b* is a partial cut-away view showing the second drive assembly.

Referring to FIGS. 3*a* and 3*b*, the left and right drive assemblies are shown in greater detail therein. With particular reference to FIG. 3*a*, the left drive assembly has the drive screw 44 coupled to cantilever assembly 46 via a bracket 50 and a non-rotatable nut (not shown). The drive screw 44 is horizontally offset from the cantilever assembly 46 so that the coupling is non-concentric. The nut 52 is angularly fixed in place via a pair of screws 73 to prevent angular rotation of the nut. The nut has a threaded surface on the inside thereof for matingly engaging the threaded outer surface of drive screw 44 to transfer the rotational movement of drive screw 44 to a linear vertical motion. A thrust bearing 54 is located between the bottom of drive screw 44 and a support surface of housing 30. The cantilever assembly 46 is connected at its lower end to bracket 50 and further has a cylindrical hollow receiving a polymeric sleeve bushing 47 at the lower end for receiving a fixed cylindrical column support 56. Column support 56 is fixed in place, such as by welding to the housing 30, and provides vertical stability to cantilever assembly 46 while allowing the cantilever assembly 46 to slide up and down.

In addition, the drive screw 44 is coupled to an output shaft 45 of gear reduction drive assembly 42 which has a cam shaped upper end (not shown) that rotates with drive screw 44. Positioned next to the cam is a microswitch 58 with a mechanical probe tip for sensing the angular position of drive screw 44.

With particular reference to FIG. 3*b*, the right drive assembly has drive screw 66 likewise coupled to a bracket 70 via a non-rotatable nut 72 which has a threaded inside surface matingly engaging the threaded outer surface of drive screw 64. Nut 72 is fixedly held in place via screws 73 to prevent angular rotation of the nut 72. Accordingly, nut 72 moves linearly up and down in response to angular rotation of drive screw 64. Nut 72 is connected to bracket 70 which is fixedly connected to the lower end of cantilever assembly 66. The drive shaft 64 is horizontally offset from the cantilever assembly 66 so that the coupling is non-concentric. Cantilever assembly 66 has a cylindrical hollow receiving a polymeric sleeve bushing 67 at the lower end for receiving a fixed cylindrical column support 76. Column support 76 is fixed in place, such as welding, to the bottom of housing 34, and provides vertical stability to cantilever assembly 66, and allows cantilever assembly 66 to slide up and down. In addition, a thrust bearing 74 is disposed between the bottom end of drive screw 64 and a support surface of housing 34. Further, a microswitch 78 with mechanical probe tip is provided to sense a cam at the upper end of the output shaft 65 of the gear reduction drive assembly 62 which is coupled to drive screw 64 to detect angular position of drive screw 64.

According to this arrangement, the left and right drive assemblies are each configured with a drive screw horizontally offset from a cantilever assembly for converting rotary motion of the drive shaft to linear motion of the cantilever assembly. By employing a horizontal offset between the drive screw and the cantilever assembly, the need for a braking mechanism is eliminated. This is because any load applied to the work surface table will, in effect, create a torque from the cantilever assemblies onto the drive screws which will prevent the work surface 12 from back driving the drive screws.

Housing 34, which contains the right drive assembly, further includes a control panel 90 which has controller 100 provided on a printed circuit board which includes a microprocessor and associated circuitry for controlling the operation of the left and right drive assemblies. Controller 100 is coupled to both electric motors 40 and 60 for energizing or de-energizing the left and right motors 40 and 60 in response to user actuation control signals. The controller 100 controls the raising and lowering of the work surface 12 to keep the work surface 12 substantially level and protects against overload and limit travel conditions.

Figure 4:
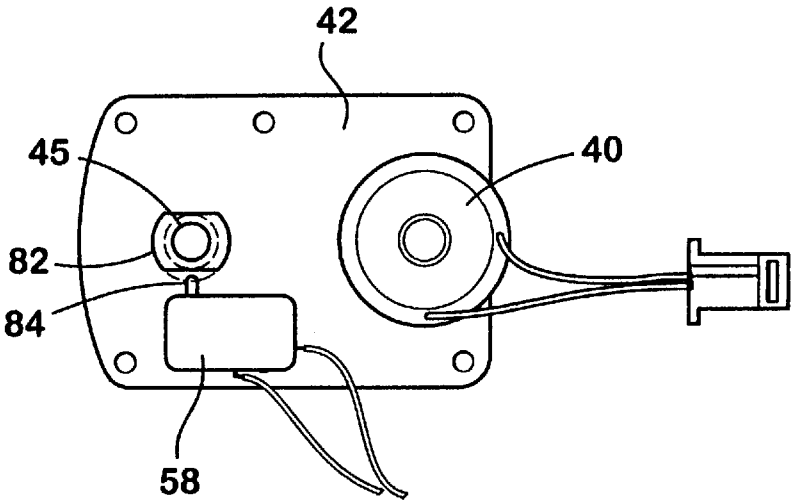
FIG. 4 is an enlarged view of the gear reduction drive assembly with an electric motor and microswitch mounted thereto.

Referring to FIG. 4, the motor control assembly for the left drive assembly is shown therein. The DC motor 40 is mounted to and engaged with gear reduction drive 42 which in turn drives an output shaft 45 that is coupled to drive screw 44. A shaped cam 82 is provided on the output shaft to rotate with the drive screw 44 and provides four equiangularly spaced position markings. As drive screw 44 rotates, cam 82 likewise rotates, and in doing so, engages and disengages a probe pin 84 on microswitch 58 to cyclically depress and release the pin 84. Whenever pin 84 transitions between an extended and contracted position, microswitch 58 detects the corresponding angular position of drive screw 44. Accordingly, microswitch 58 detects four angular positions for each 360 degree rotation of drive screw 44. It should be appreciated that the right drive assembly is likewise configured with a cam, microswitch, and pin assembly for detecting angular position identical to that disclosed for the left drive assembly.

Figure 5:
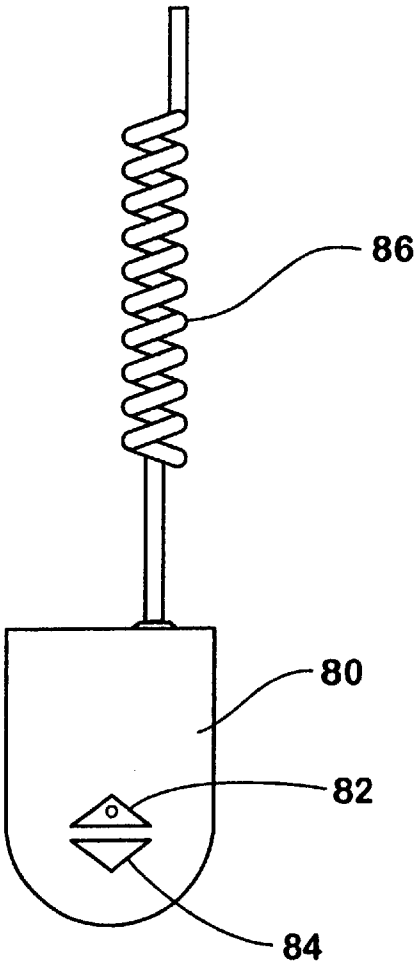
FIG. 5 is a perspective view of a pendant control for controlling the height adjustable table assembly.

The pendant control 80 is further shown in FIG. 5. The pendant control 80 has a housing with user actuable momentary switches 82 and 84 provided on the top surface for controlling the raising and lowering of the work surface 12. Control signals are sent to the controller via electrical cable 86 to raise the work surface by depressing up switch 82, or to lower the work surface by depressing down switch 84. In addition, the pendant control 80 has a leveling mode and may be set to the leveling mode by depressing both momentary switches for a predetermined period of time, such as five seconds. Once in the leveling mode, certain protective features are overridden such as the error check control subroutine and the balance control subroutine to move the work surface 12 up or down for purposes of quickly releveling the work surface 12.

Figure 6:
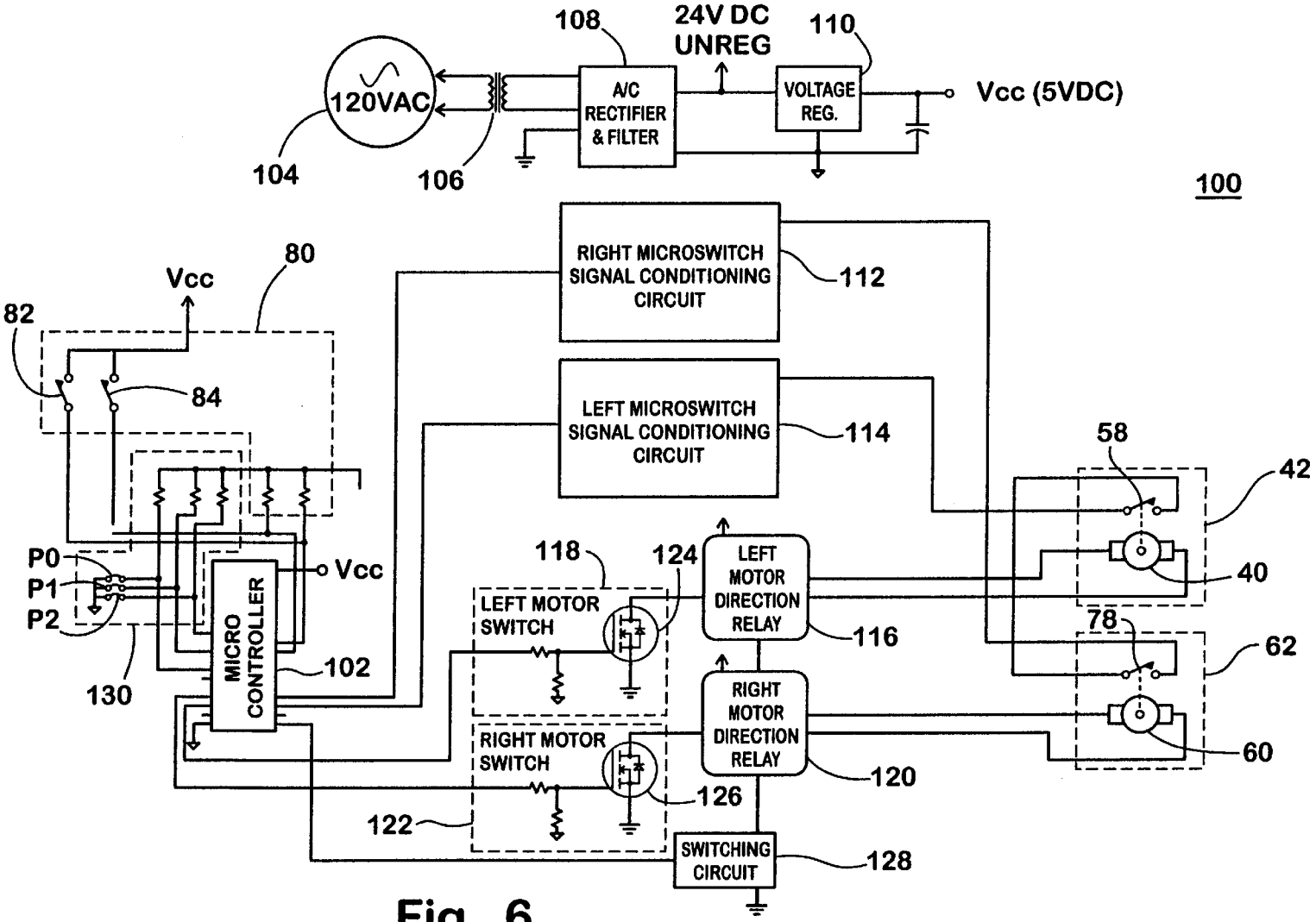
FIG. 6 is a circuit diagram illustrating the controller for controlling the height adjustable table assembly.

The controller circuitry 100 is illustrated in FIG. 6, with well-known circuitry illustrated in block format. The controller circuitry 100 includes a microprocessor-based controller 102 and various circuit components generally assembled on a printed circuit board. The microcontroller 102 may include a standard off-the-shelf microprocessor such as Model No. PIC165XX manufactured by Microchip Technology Inc. The microcontroller 102 has memory associated therewith, such as flash memory, for storing programmed software for controlling operation of the motorized height adjustable table 10 as described herein.

The controller circuitry 100 includes a 120-volt AC power supply input 104 coupled to a transformer 106 for stepping the voltage input down to 24-volts AC. An AC rectification and filtering circuit 108 converts the 24-volt AC signal to a 24-volt DC signal. The 24-volt DC signal is used to power electric motors 40 and 60 as well as microswitches 58 and 78. A voltage regulator 110 is also provided to produce a reduced DC voltage $V_{cc}$ of five volts. The voltage $V_{cc}$ is generally used to power the printed circuitry and the microprocessor 102.

The control circuitry 100 includes a right microswitch signal conditioning circuit 112 connected to an output line of the right microswitch 78. Likewise, a left microswitch signal conditioning circuit 114 is connected to an output line of the left microswitch 58. The signal conditioning circuits 112 and 114 condition the corresponding microswitch signals which are indicative of the sensed angular position of corresponding drive screws 44 and 64. The signal conditioning circuits 112 and 114 include circuitry for reducing the DC voltage signals from a range of 0 to 24 volts to within a more limited range of 0 to 5 volts, and for filtering unwanted noise from the signals. It should be appreciated that the signal conditioning circuits 112 and 114 may include well-known signal conditioning circuitry. The output of signal conditioning circuits 112 and 114 are both input to the microcontroller 102 which monitors the signals to determine the sensed angular position of the left and right drive assemblies based on signal transitions that are detected by the corresponding microswitches 58 and 78.

The controller circuitry 100 also includes a left motor direction relay 116 and a left motor switch 118. Similarly, also provided is a right motor direction relay 120 and a right motor switch 122. The left and right motor direction relays 116 and 120 are connected to the power input lines of left and right motors 40 and 60, respectively, for energizing and de-energizing the corresponding motors when a motor energization control signal is provided by microcontroller 102. The left and right motors 40 and 60 are each independently controlled such that each motor is either energized at a fixed (non-variable) angular speed or de-energized.

The left and right motor switches 118 and 122 provide low power switching circuitry to switch "on" the corresponding left and right motor 40 and 60. The left motor switch 118 includes an N-channel FET transistor 124 for switching "on" motor 40, while the right motor switch 122 likewise includes an N-channel FET transistor 126 for switching "on" the motor 60. It should be appreciated that the use of N-channel FET transistors 124 and 126 provides low heat generation due to low "on" resistance, which allows for the elimination of heat sinks. In A1 addition, switching circuitry 128 is provided to control the direction relays 116 and 120 which in turn control the direction that the motors 40 and 60 are to be engaged. Switching circuitry 128 is controlled in response to a direction control signal output from microcontroller 102.

The pendant control 80 is further shown with momentary switches 82 and 84 connected as inputs to the microcontroller 102. In addition, switching circuitry 130 is provided including three programming pins $P_0$, $P_1$, and $P_2$. Programming pins $P_0$ through $P_2$ are mechanical pins that can be inserted into or removed from contact terminals to close or open contacts. Programming pins $P_0$ through $P_2$ are manually selectable so as to adjust the multiplication factor for varying the time periods $\Delta t_{up}$ and $\Delta t_{down}$, which define the overload time up and down periods, respectively, for detecting an overload or limit condition. Accordingly, the programming pins $P_0$ through $P_2$ may be changed in the field by a technician without requiring software reprogramming to adjust or tune the overload/limit protection time periods. This allows the control system to be easily modified for use with different work surfaces. Accordingly, the motor control drive assembly of the present invention is modular in that it may be used on various types of tables for various applications, and may be modified by changing the programming pins $P_0$ through $P_2$, without requiring reprogramming of the software.

Figure 7A:
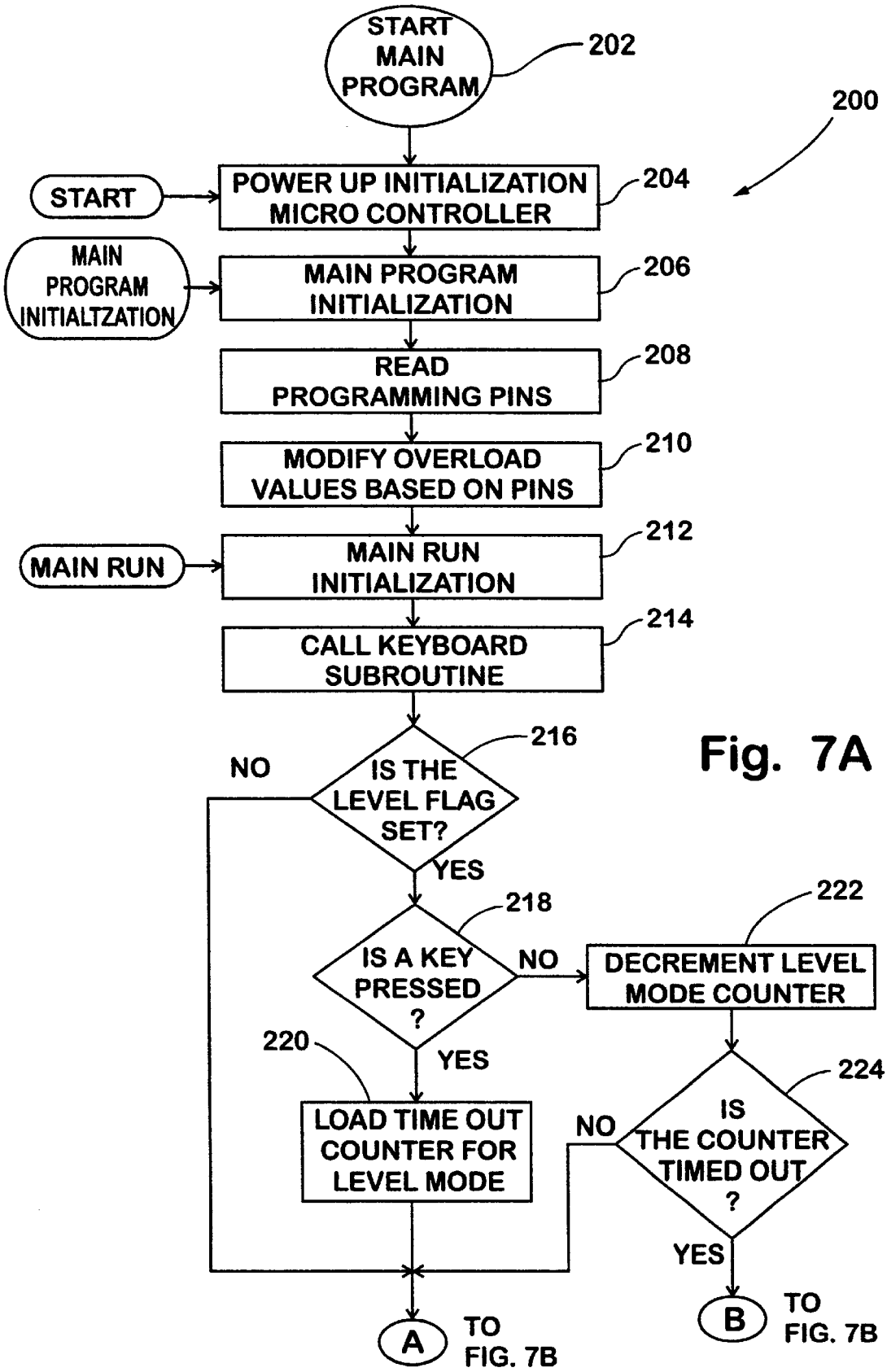
FIGS. 7*a* and 7*b* are flow diagrams illustrating the overall main control operations for the height adjustable table assembly.
Figure 7B:
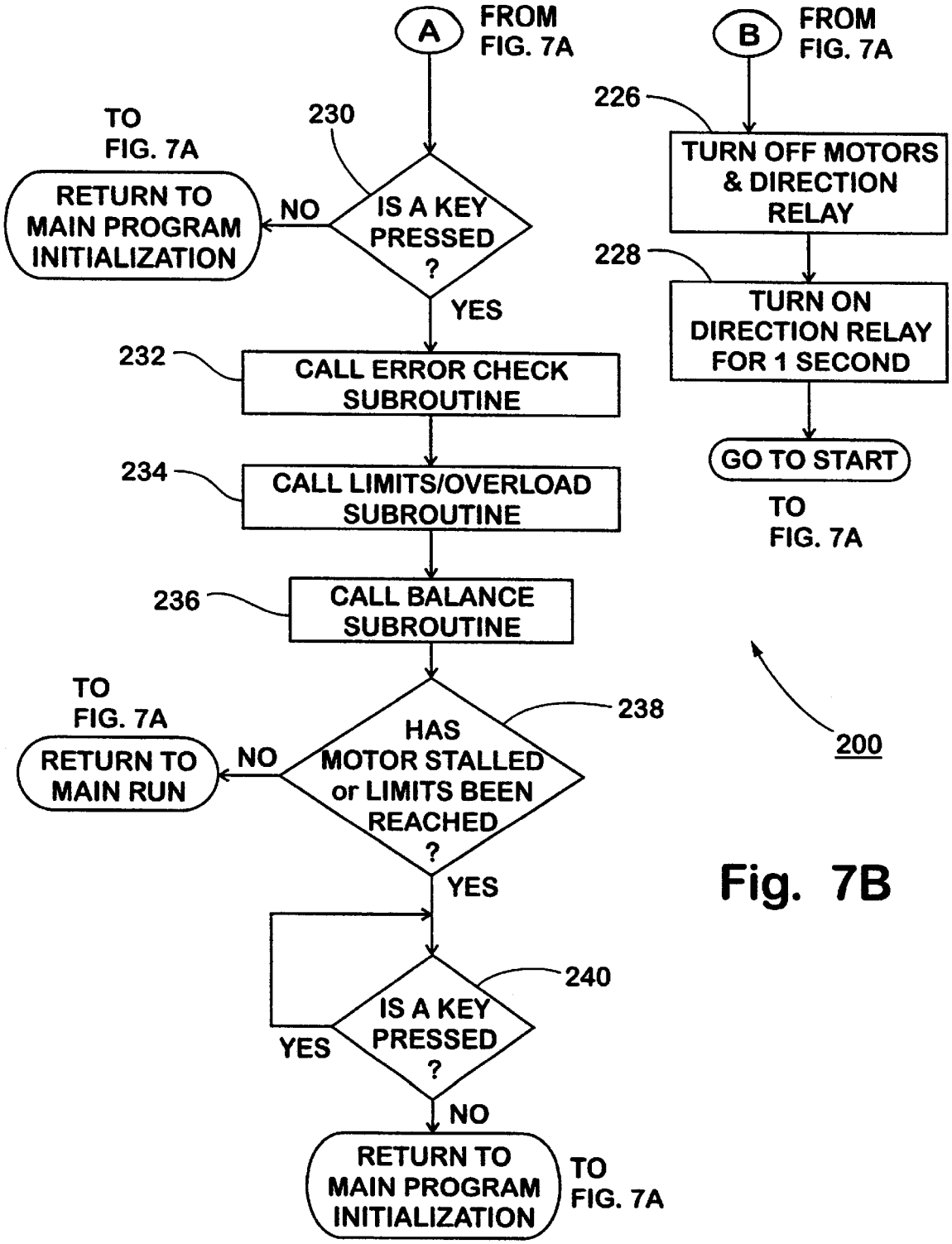

The microcontroller 102 is programmed to control the operation of the height adjustable table assembly 10. In doing so, the microcontroller 102 performs a main program operation as set forth in FIGS. 7*a* and 7*b*. The main program methodology 200 starts at step 202 and proceeds to a power up initialization of the microcontroller in step 204. Next, methodology 200 proceeds to initialize the main program in step 206 and reads the manually selectable programming pins in step 208. The manually selectable programming pins $P_0$ through $P_2$ may be manually adjusted to vary the overload time periods $\Delta t_{up}$ and $\Delta t_{down}$ by selectable multiplication factors. According to the three pin embodiment shown and described herein, a total of eight different multiplication factors are available which correspond to eight binary combinations.

Once the programming pins are read, methodology 200 proceeds to modify the up and down overload time values $\Delta t_{up}$ and $\Delta t_{down}$ based on the selection of the programming pins in step 210. In step 212, the main run initialization is performed, and methodology 200 proceeds to step 214 to call the keyboard control subroutine which is described in connection with FIG. 8. Following completion of the keyboard control subroutine, methodology 200 checks for whether the level flag is set in decision block 216. If the level flag is set, methodology 200 checks to see if a pendant key is currently pressed and, if so, proceeds to load the time out counter for the level mode in step 220. If no pendant key is pressed, methodology 200 proceeds to step 222 to decrement the level mode counter, and then checks for whether the counter has timed out in decision block 224. If the counter has timed out, methodology 200 proceeds to turn "off" i.e., de-energize, the motors and direction relays in step 226, and proceeds to turn "on" i.e., energize, the direction relay for a one second time period in step 228, and then proceeds back to step 204.

If the level flag has not been set as determined in block 216, or if the counter has not timed out as determined in block 224, or the counter has been loaded for the level mode in step 220, methodology 200 proceeds to check for whether a pendant key is pressed in decision block 230 and, if not, returns to step 206. If a pendant key is pressed, methodology 200 calls for an error check control subroutine in step 232 which is further set forth in FIG. 9. The error check control subroutine essentially ensures that the work surface is not too far off balance. Following the error check control subroutine, methodology 200 proceeds to step 234 to call the limits/overload control subroutine which is further set forth in FIG. 10. Next, in step 236 the balance control subroutine is performed which is set forth in FIG. 11. Following the balance control subroutine, methodology 200 checks to see if a motor has stalled or the limits have been reached and, if not, returns to step 212. If a motor has stalled or the limits have been reached, methodology 200 proceeds to decision block 240 to check if any pendant key is pressed, and will wait until the pendant key is no longer pressed before returning back to step 206.

Figure 8:
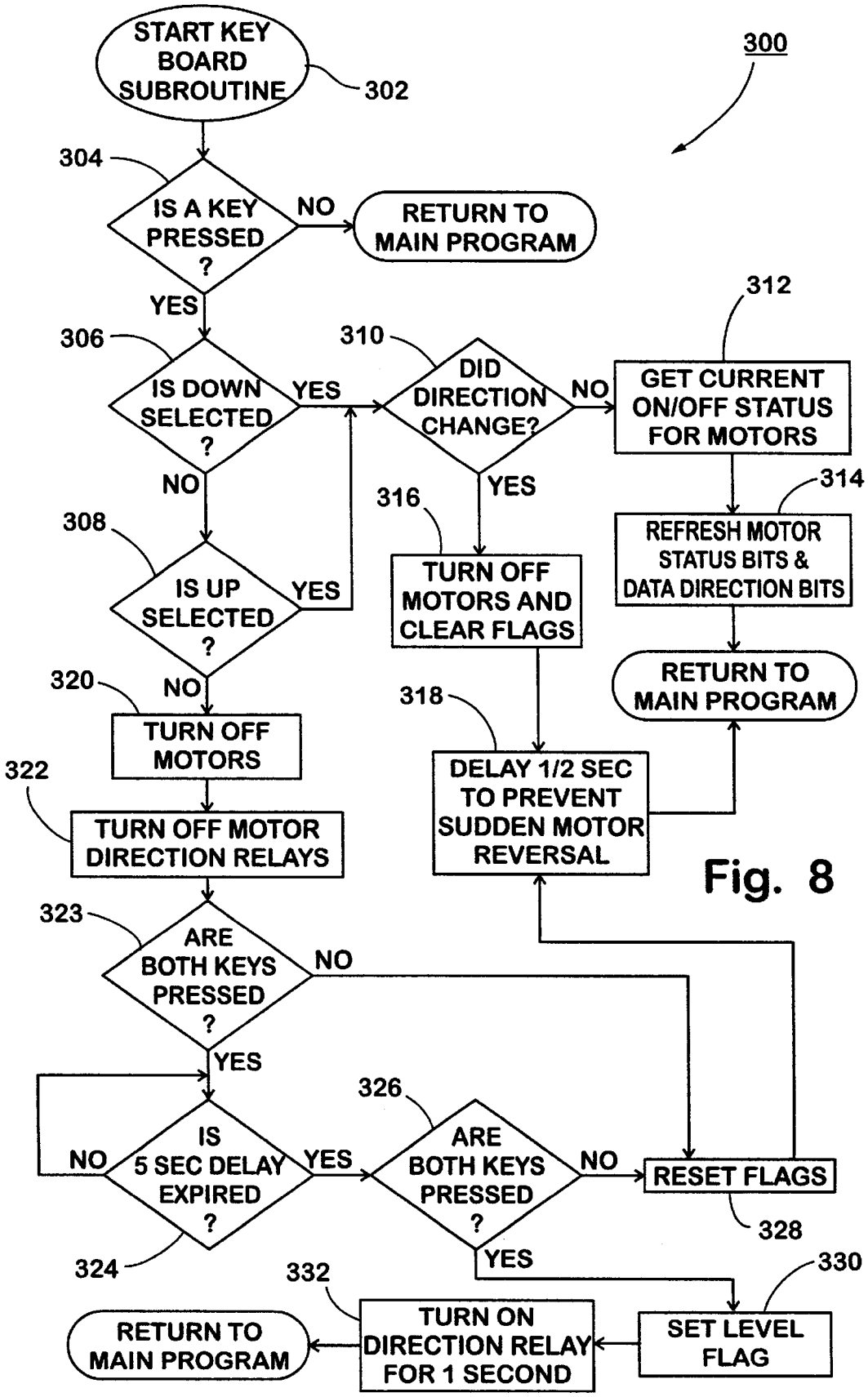
FIG. 8 is a flow diagram illustrating the keyboard control subroutine for use in controlling operation of the height adjustable table.

Referring to FIG. 8, the keyboard control subroutine methodology 300 is illustrated therein. Keyboard control subroutine 300 monitors the keyboard pendant and determines the user selected motion direction. If the two keys are simultaneously pressed for a period of time, the control routine sets a leveling flag to enter a leveling mode that is used to skip around the balance control subroutine and error check control subroutine. If a change in direction is detected, the keyboard control subroutine 300 shuts "off" both motors for one-half second to prevent sudden motor reversal for the purpose of preventing damage from occurring to the motors.

Keyboard control subroutine 300 starts at step 302 and proceeds to decision block 304 to see if a pendant key is currently depressed and, if not, returns back to the main program. If a pendant key is currently depressed, methodology 300 proceeds to decision block 306 to check if the pendant down key 84 is selected, and if not, proceeds to decision block 308 to check if the up pendant key 82 has been selected. If either of the down or up keys have been selected, methodology 300 proceeds to decision block 310 to check whether the direction has changed. If a direction change has not occurred, the current on/off status for the motors is obtained in step 312 and the motor status bits and data direction bits are refreshed in step 314 before returning to the main program. If the direction has changed, the motors are turned "off" and flags are cleared in step 316, and a one-half second delay is provided in step 318 to prevent sudden motor reversal for the purpose of preventing damage to the motors, prior to returning to the main program.

If neither the up or down pendant keys have been selected, methodology 300 proceeds to turn "off" the motors in step 320 and to turn "off" the motor direction relays in step 322. Decision block 323 then checks for whether both keys are depressed and, if not, proceeds to reset the flags in step 328. If both keys are pressed, decision block 324 then checks for whether a five second delay has expired and, once expired, proceeds to decision block 326 to check if both pendant keys are still pressed simultaneously and, if not, resets the flags in step 328 and proceeds to step 318. Otherwise, if both keys have been pressed for five seconds, methodology 300 proceeds to set the level flag in step 330 and turns "on" the direction relay for one second in step 332 before returning to the main program.

Figure 9:
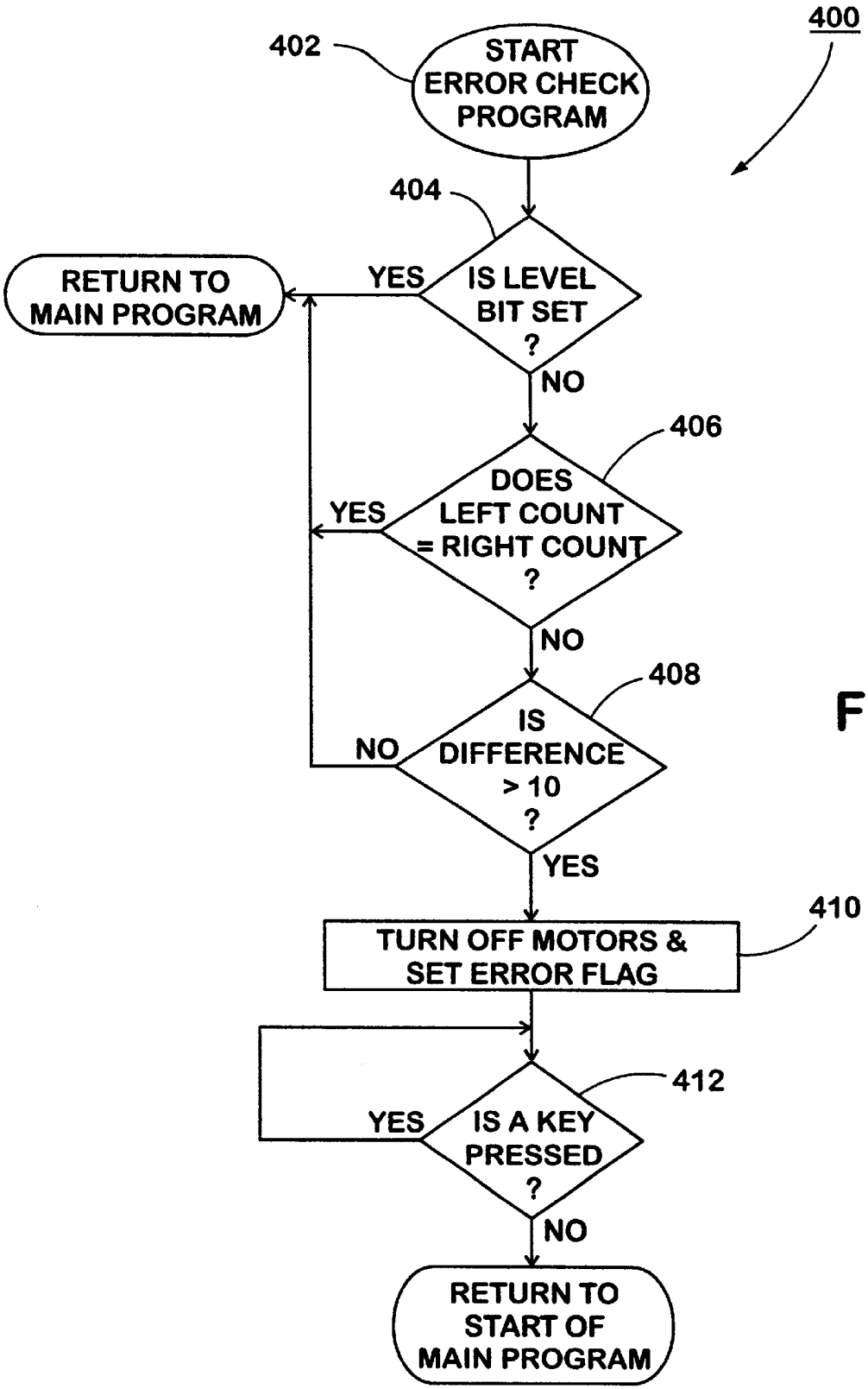
FIG. 9 is a flow diagram illustrating the error check control subroutine for detecting an excessively unlevel work surface.

The error check control subroutine 400 is shown in FIG. 9. The error check control subroutine 400 monitors the left and right counters and, if a count difference exceeds a set value, such as ten for example, the motors are shut down. In addition, an error flag is set, and the unit will remain locked out until all keys on the pendant control are released. Further, the error check control subroutine 400 is skipped whenever the main control operation is in the leveling mode.

Error check control subroutine 400 starts at step 402 and proceeds to decision block 404 to check if the level bit is set and, if so, returns to the main program. Otherwise, decision block 406 checks for whether the left count is equal to the right count and, if so, returns to the main program. If the left and right counts are not equal, decision block 408 will check to see if the difference between the left and right counts is greater than the set value of ten. If the difference in left and right count values is greater than a value of ten, methodology 400 proceeds to turn "off" the motors and sets the error flag in step 410. Otherwise, methodology 400 returns to the main program. Following shut off of the motors and setting the error flag, methodology 400 proceeds to decision block 412 and waits until a pendant key is no longer depressed before proceeding to return to the start of the main program. Accordingly, when the count difference between the left and right counters is greater than ten, the motors are shut off and the program returns to the beginning of the main program to begin initialization of the system.

Figure 10:
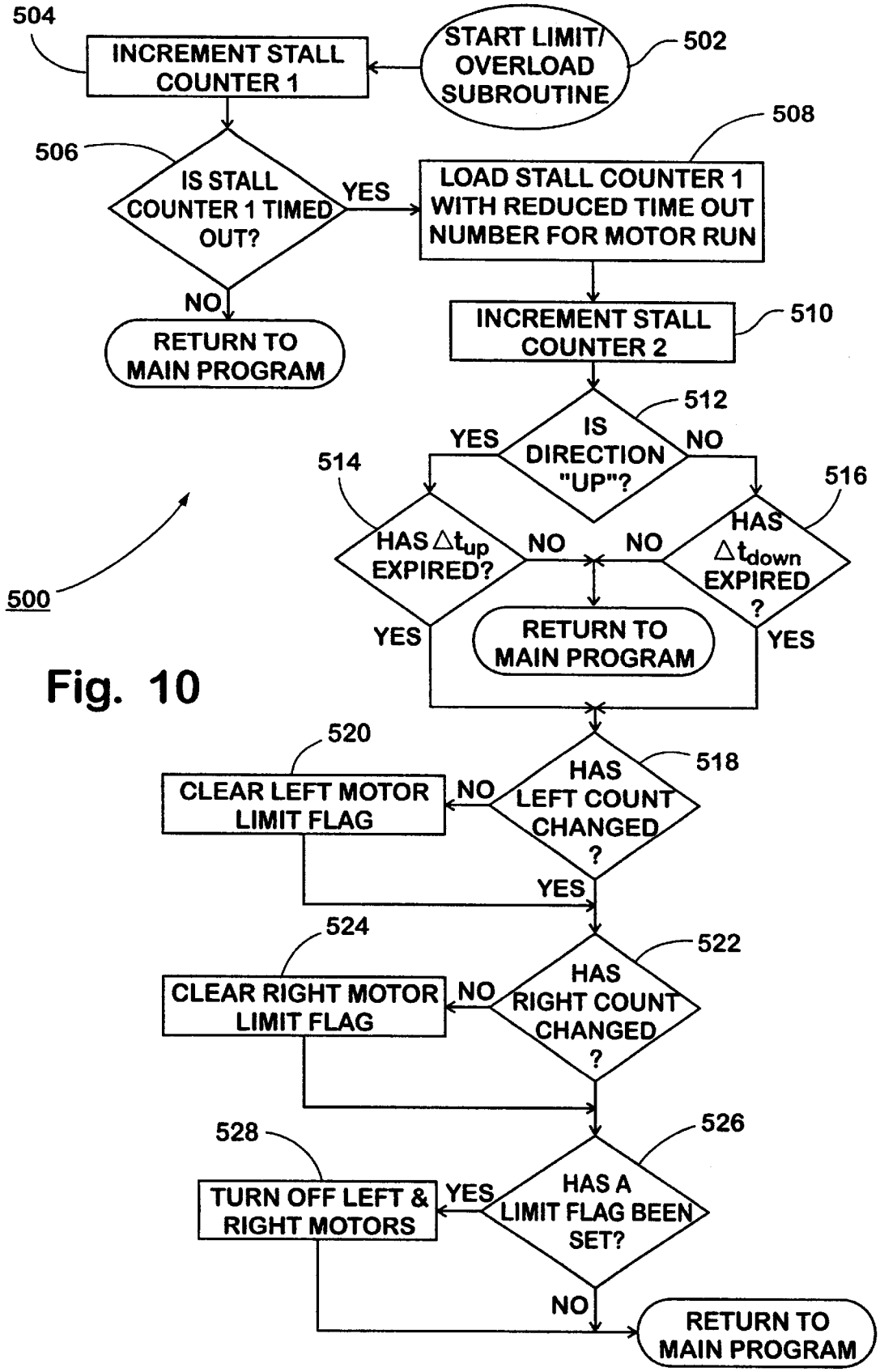
FIG. 10 is a flow diagram illustrating the limit/overload control subroutine for shutting down the motors when an overload or limit condition is detected.

The limit/overload control subroutine is illustrated in FIG. 10. The limit/overload control subroutine 500 monitors the position count of left and right registers and checks for whether a count does not occur in either the left or right register within a set time period to detect the presence of a limit or overload condition. Upon detecting a limit or overload condition, the limit/overload control subroutine 500 shuts off both motors and resets flags to indicate a limit or overload condition has occurred. The control subroutine 500 will then test the error flags for appropriate action.

The limit/overload control subroutine 500 starts at step 502 and proceeds to increment a stall counter 1 in step 504. Next, decision block 506 checks for whether the stall counter 1 has timed out, and if not, returns to the main program. If counter 1 has timed out, methodology 500 proceeds to load stall counter 1 with a reduced timeout number for motor run in step 508, and then proceeds to step 510 to increment stall counter 2. This allows for an initial increase in the time period when the motors are initially energized and prevents false overload trip outs from occurring due to the motor overcoming inertia and coming up to speed.

In decision block 512, methodology 500 checks for whether the motor direction is up. If the motor direction is up, decision block 514 checks for whether the overload up time period $\Delta t_{up}$ has expired and, if not, returns to the main program. If the motor direction is down, decision block 516 checks for whether the overload down time period $\Delta t_{down}$ has expired and, if not, returns to the main program. If the overload up time period $\Delta t_{up}$ or down time period $\Delta t_{down}$ has expired as determined by decision blocks 514 and 516, methodology 500 proceeds to decision block 518 to check if the left count has changed, and if so, proceeds to decision block 522 to see if the right count has changed. If the left count has not changed, the left motor limit flag is cleared in step 520. Likewise, if the right count has not changed, the right motor limit flag is cleared in step 524. Control methodology 500 then proceeds to check in decision block 526 for whether a limit flag has been set and, if so, turns off the left and right motors in step 528. For either event, methodology 500 then returns to the main program.

Figure 11:
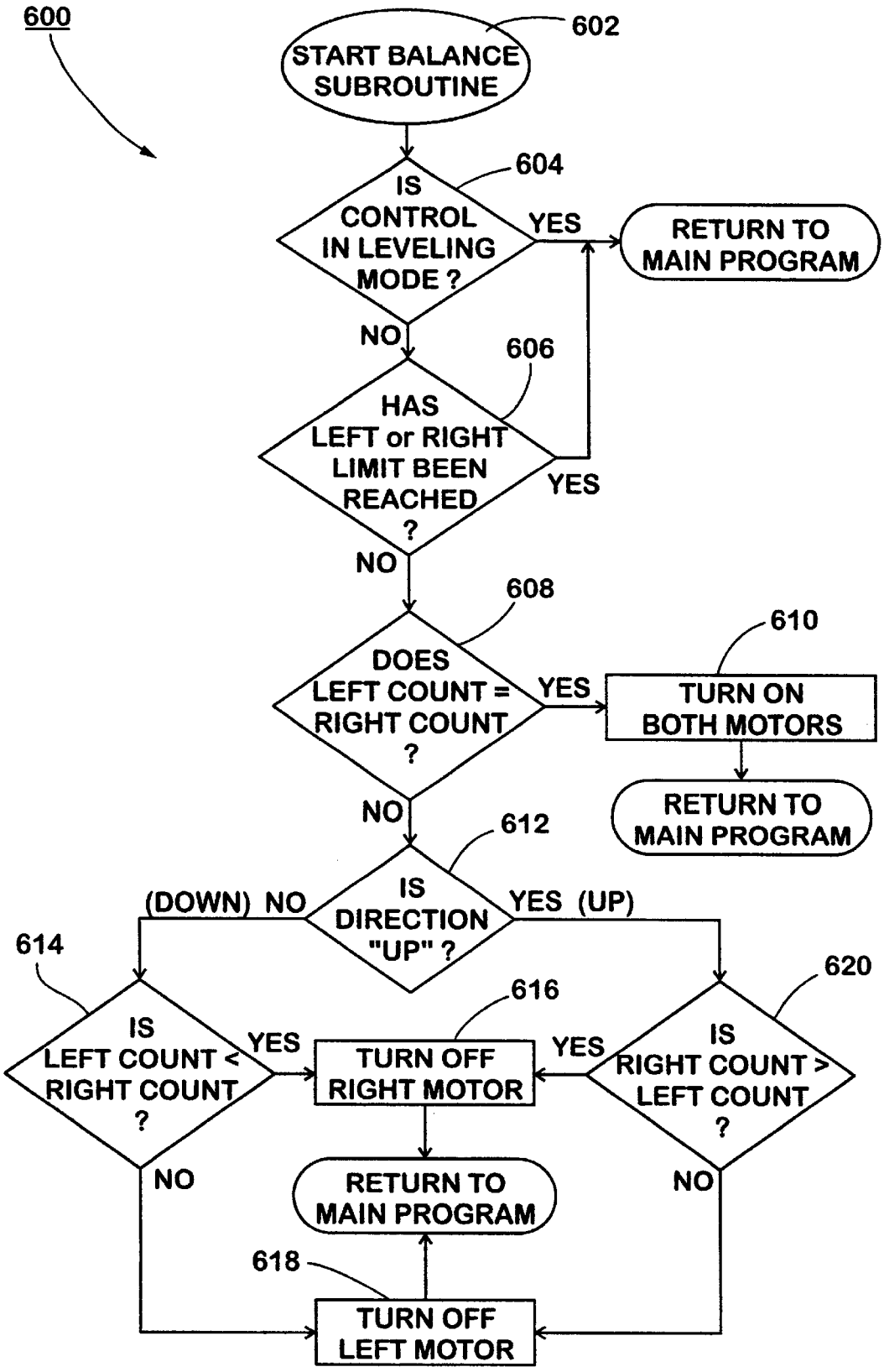
FIG. 11 is a flow diagram illustrating the balance control subroutine for maintaining a level work surface.

The balance control subroutine is shown in FIG. 11. The balance control subroutine 600 monitors the left gear motor and right gear motor counter registers and the difference therebetween. If there is a difference between the left and right counts, the leading motor is shut "off" until the lagging motor catches up in order to balance the position of the left and right drive assemblies. That is, when the motors are energized and raising the work surface 12, if the position of one of the drive assemblies is higher than the other assembly, the motor for the higher drive assembly is shut "off" until the lower drive assembly catches up. Likewise, for a downward motion, the motor for the lower drive assembly is shut "off" until the higher drive assembly catches up.

Balance control subroutine 600 starts at step 602 and proceeds to decision block 604 to check whether the control is in the leveling mode and, if so, skips the balance control routine and returns to the main program. Methodology 600 likewise checks for whether the left or right limit has been reached and, if so, skips the balance control routine and returns to the main program. Otherwise, decision block 608 checks for whether the left count is equal to the right count and, if so, turns on both motors in step 610, and thereafter returns to the main program. If the left count does not equal the right count, balance control methodology 600 proceeds to decision block 612 to check if the work surface is moving in the up direction. If the work surface is moving in the down direction, decision block 614 checks whether the left count is less than the right count and, if so, turns "off" the right motor and returns to the main program. If the right count is less than the left count, step 618 turns "off" the left motor and then returns to the main program. If the workstation is moving in the up direction, decision block 620 checks for whether the right count is greater than the left count and, if so, turns "off" the right motor in 616, and then returns to the main program. However, if the left count is greater than the right count, decision block 620 proceeds to turn "off" the left motor in 618, and then returns to the main program. Accordingly, the leading motor is shut off until the lagging motor catches up.

Figure 12:
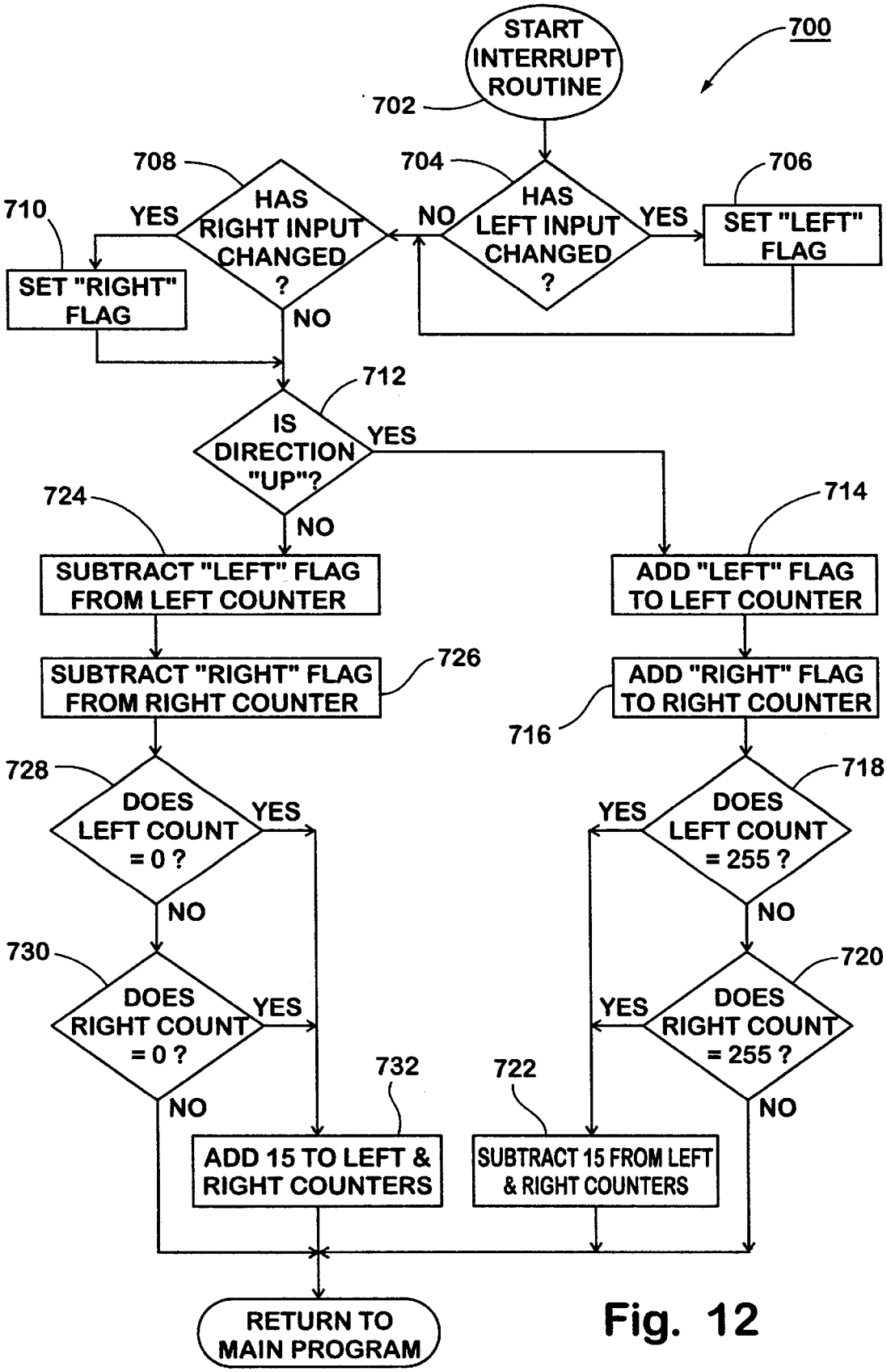
FIG. 12 is a flow diagram illustrating the interrupt control routine for generating left and right drive assembly position counts.

The control system of the present invention monitors the outputs of microswitches 58 and 78 which provide signals indicative of the position of the probe pins contacting the cam on the corresponding drive screws, which thereby provides an angular position signals. To accurately detect an angular position signal, the control system further employs an interrupt control routine 700 which is shown in FIG. 12. Interrupt control routine 700 generates an interrupt whenever a voltage transition occurs on either the left or right counter inputs to the microcomputer. By generating an interrupt at each transition rather than a level change, twice the number of counts per revolution of the cam are achievable which provides improved position measuring resolution. The use of an interrupt ensures than an angular position count is not missed.

The interrupt control methodology 700 begins at step 702 and proceeds to decision block 704 to check if the left input has changed and, if so, sets the left flag in step 706. Decision block 708 then checks for whether the right input has changed and, if so, sets the right flag in step 710. Methodology 700 then proceeds to decision block 712 to check if the workstation is moving in the up direction.

If the workstation is moving in the up direction, the left flag is added to the left counter in step 714 and the right flag is added to the right counter in step 716. Decision block 718 then checks if the left count is equal to a count of 255 and, if so, subtracts a value of 15 from the left and right counters in step 722. Decision block 720 checks to see if the right count is equal to a count of 255 and, if so, likewise subtracts a value of 15 from the left and right counters in step 722 and then returns to the main program. By subtracting a value of 15, the 8-bit counter is able to track the relative position of the left and right counters with a maximum count range from 0 to 255, and simply readjusts the count value of both counters when exceeding the range of 0 to 255.

If the work surface is moving in the down direction as determined by decision block 712, the left flag is subtracted from the left counter in step 724 and the right flag is subtracted from the right counter in step 726. Decision block 728 then checks whether the left count equals 0, and decision block 730 checks whether the right count equals 0. If either the left or right counters equal 0, a count value of 15 is added to both the left and right counters in step 732. Thereafter, methodology 700 returns to the main program. Accordingly, whenever the left or right counter approaches 0 on the downward movement, a count value of 15 is simply added to both the left and the right counters to maintain a relative position count between the left and right sides. As a result, the left and right counters provide a relative count difference, but do not provide an absolute position measurement for the left and right sides of the work surface.

To operate the table assembly 10, a user may depress either the up or down pendant keys of the pendant control 80 in order to raise or lower, respectively, the work surface 12. When a user depresses the pendant down key, the controller simultaneously energizes the left and right motors to lower the respective left and right sides of table 12. Likewise, when the user depresses the up key, the controller switches the direction relays and simultaneously energizes the left and right motors to raise work surface 12. In doing so, the controller monitors the position of the left and right drive assemblies and compares a position count for both the left and right sides. Whenever there is a difference between the position counts on the left and right sides, the controller shuts off the motor associated with the lead assembly until the count difference between the left and right position counts is equal to 0. Accordingly, the work surface 12 remains substantially level while moving up and down.

In addition, the controller monitors the rate of change of position count for each of the left and right assemblies, and compares the rate with an overload limit value to detect either an overload condition or a limit condition. In doing so, the controller looks for a change in position count during an overload time period $\Delta t_{up}$ or $\Delta t_{down}$. If no count occurs within the overload time period $\Delta t_{up}$ or $\Delta t_{down}$, an overload or limit condition is detected and, in response thereto, both the left and right motors are de-energized. The overload time period $\Delta t_{up}$ is generally longer than the time period $\Delta t_{down}$, to compensate for gravitational effect. In addition, the overload time period may be extended at the beginning of a motor start up. In any event, the present table assembly 10 does not require the use of external limit switches or overload switches to detect an overload or limit condition.

In the event that work surface 12 becomes substantially unlevel, the operator may depress both the up and down pendant keys 82 and 84 for a predetermined time period of five seconds to enter the leveling mode. In the leveling mode, the user is able to move the table up and down by depressing the up and down pendant keys, respectively. In the leveling mode, the operator may raise work surface 12 to its uppermost limit or its lowermost limit to reset the work surface 12 to a substantially level arrangement.

While first and second drive assemblies having first and second electric DC motors are shown and described herein in connection with the present invention, it should be appreciated that the teachings of the present invention are not limited to two DC motors. For example, three or more DC motors could be employed at different locations of the work surface without departing from the spirit of the present invention. In addition, it should also be appreciated that AC motors could be used according to another embodiment.

It will be understood by those who practice the invention and those skilled in the art, that various modifications and improvements may be made to the invention without departing from the spirit of the disclosed concept. The scope of protection afforded is to be determined by the claims and by the breadth of interpretation allowed by law.

The invention claimed is:

1. A motorized height adjustable table comprising:

a support base;

a top assembly including a substantially horizontally disposed work surface;

a first powered drive assembly including a first electric motor drivingly engaged with said top assembly at one location for effecting vertical movement of said top assembly to adjust the height of the work surface, said first powered drive assembly further including a first drive screw and a first cantilever assembly horizontally offset from said first drive screw and operatively connected thereto, such that said first dive screw raises and lowers said first cantilever assembly to correspondingly raise and lower said work surface;

a second powered drive assembly including a second electric motor drivingly engaged with said top assembly at another location for effecting vertical movement of said top assembly to adjust the height of the work surface, said second powered drive assembly including a second drive screw and a second cantilever assembly horizontally offset from said second drive screw and operatively connected thereto, such that said second drive screw raises and lowers said second cantilever assembly to correspondingly raise and lower said work surface, wherein the horizontal offset of said first and second cantilever assemblies relative to the first and second drive screws resists back drive of the first and second drive screws when load is applied to the work surface; and a controller coupled to said first and second drive assemblies for simultaneously controlling said first and second motors.

2. The table as defined in claim 1, wherein said controller further senses a relative height displacement between said first and second cantilever assemblies and de-energizes one of said first and second motors until the relative height displacement between the first and second cantilever assemblies is substantially zero.

3. The table as defined in claim 2 further comprising a first position sensor for sensing the angular position of said first drive screw and a second position sensor for sensing the angular position of said second drive screw.

4. The table as defined in claim 3, wherein said first and second sensors each comprises a microswitch.

5. The table as defined in claim 1, wherein said controller further senses displacement of said first and second cantilever assemblies over a time period and de-energizes said first and second motors when said sensed displacement is indicative of an overload condition.

6. The table as defined in claim 5 further comprising a manually operable switch for adjusting overload detection set points.

7. A motorized height adjustable table comprising:

a support base;

a top assembly including a substantially horizontally disposed work surface;

a first powered drive assembly including a first electric motor and first drive arm engaged with said top assembly at one location for effecting vertical movement of said top assembly to adjust the height of the work surface;

a second powered dive assembly including a second electric motor and second drive arm engaged with said top assembly at another location for effecting vertical movement of the top assembly to adjust the height of the work surface; and a controller coupled to said first and second drive assemblies for simultaneously controlling said first and second motors to move said first and second drive arms, said controller sensing displacement of each of said first and second drive arms and determining a rate of displacement over a period of time for each of said first and second drive arms, said controller de-energizing said first and second motors as a function of said rate of displacement when said rate of displacement is indicative of one of a travel limit and an overload condition.

8. The table as defined in claim 7, wherein said controller further compares said rate of displacement with a set value and de-energizes said first and second motors as a function of said comparison.

9. The table as defined in claim 8, wherein said set value comprises a first value when the work surface is being raised and a different second value when the work surface is being lowered.

10. The table as defined in claim 8, further comprising a manually actuable switch for selecting said set value.

11. The table as defined in claim 10, wherein said manually actuable switch comprises one or more contact pins.

12. The table as defined in claim 7, wherein said rate of displacement comprises a position count change during a set time period.

13. The table as defined in claim 7, wherein said first and second powered drive assemblies each comprises a rotary to linear motion converter including a drive screw manually connected to a cantilever assembly for moving said cantilever assembly linear up and down in response to rotary motion of said drive screw.

14. The table as defined in claim 13, wherein said cantilever assembly is horizontally spaced from said drive screw such that load on said work surface causes a torque on said work surface to resist back drive movement.

15. A motorized height adjustable table comprising:

a support base;

a top assembly including a substantially horizontally disposed work surface;

a powered drive assembly including an electric motor drivingly engaged with said top assembly at one location for effecting vertical movement of said top assembly to adjust the height of the work surface, said powered drive assembly further including a drive screw and a cantilever assembly horizontally offset from said drive screw and operatively connected thereto, such that said drive screw raises and lowers said cantilever assembly to correspondingly raise and lower said work surface, wherein the horizontal offset of said cantilever assembly relative to the drive screw resists back drive of the drive screw when load is applied to the work surface; and a controller coupled to said drive assembly for simultaneously controlling said motor.

16. The table as defined in claim 15 further comprising a position sensor for sensing the angular position of said drive screw.

17. The table as defined in claim 16, wherein said sensor comprises a microswitch.

18. The table as defined in claim 14, wherein said controller further senses displacement of said cantilever assembly over a time period and de-energizes said motor when said sensed displacement is indicative of an overload condition.

19. The table as defined in claim 18 further comprising a manually operable switch for adjusting overload detection set points.

20. A motorized height adjustable table comprising:

a support base;

a top assembly including a substantially horizontally disposed work surface;

a powered drive assembly including an electric motor and drive arm engaged with said top assembly at one location for effecting vertical movement of said top assembly to adjust the height of the work surface; and a controller coupled to said drive assembly for controlling said motor to move said drive arm, said controller sensing displacement of said drive arm and determining a rate of displacement over a period of time for said drive arm, said controller de-energizing said motor as a function of said rate of displacement when said rate of displacement is indicative of one of a travel limit and an overload condition.

21. The table as defined in claim 20, wherein said controller further compares said rate of displacement with a set value and de-energizes said motor as a function of said comparison.

22. The table as defined in claim 21, wherein said set value comprises a first value when the work surface is being raised and a different second value when the work surface is being lowered.

23. The table as defined in claim 21 further comprising a manually actuable switch for selecting said set value.

24. The table as defined in claim 23, wherein said manually actuable switch comprises one or more contact pins.

25. The table as defined in claim 20, wherein said rate of displacement comprises a position count change during a set time period.

26. The table as defined in claim 20, wherein said powered drive assembly comprises a rotary to linear motion converter including a drive screw manually connected to a cantilever assembly for moving said cantilever assembly linear up and down in response to rotary motion of said drive screw.

27. The table as defined in claim 26, wherein said cantilever assembly is horizontally spaced from said drive screw such that load on said work surface causes a torque on said work surface to resist back drive movement.

* * * * *

UNITED STATES PATENT AND TRADEMARK OFFICE

CERTIFICATE OF CORRECTION

PATENT NO. : 6,286,441 B1
DATED : September 11, 2001
INVENTOR(S) : Roger D. Burdi et al.

It is certified that error appears in the above-identified patent and that said Letters Patent is hereby corrected as shown below:

Column 7,
Line 26, delete "A1".

Column 14,
Line 28, "claim 14" should be -- claim 15 --.

Signed and Sealed this

Fourteenth Day of May, 2002

*Attest:*

*Attesting Officer*

JAMES E. ROGAN
*Director of the United States Patent and Trademark Office*